United States Patent [19]

D'Angelo et al.

[11] Patent Number: 4,829,966

[45] Date of Patent: May 16, 1989

[54] GASOLINE FEED DEVICE FOR INTERNAL COMBUSTION ENGINE

[75] Inventors: Domenico D'Angelo, Monza; Marco Visconti, Bollate, both of Italy

[73] Assignee: Alfa Romeo Auto S.p.A., Naples, Italy

[21] Appl. No.: 8,759

[22] Filed: Jan. 30, 1987

[30] Foreign Application Priority Data

Feb. 4, 1986 [IT] Italy ..... 19292 A/86

[51] Int. Cl.[4] ..... F02D 41/10; F02D 41/34

[52] U.S. Cl. ..... 123/478; 123/492

[58] Field of Search ..... 123/478, 492, 470, 472, 123/491, 179 L

[56] References Cited

U.S. PATENT DOCUMENTS

| | | | |
|---|---|---|---|
| 3,673,989 | 7/1972 | Aono et al. | 123/492 X |
| 3,847,130 | 11/1974 | Miyoshi et al. | 123/179 L |
| 4,002,152 | 1/1977 | Hoshi | 123/487 X |
| 4,242,992 | 1/1981 | Kawamura et al. | 123/179 L X |
| 4,346,681 | 8/1982 | Schleicher et al. | 123/179 L |
| 4,354,470 | 10/1982 | Miyaki et al. | 123/472 |
| 4,418,672 | 12/1983 | Muller et al. | 123/489 X |
| 4,487,188 | 12/1984 | Inoue et al. | 123/491 |
| 4,612,904 | 9/1986 | Tadokoro et al. | 123/492 |

FOREIGN PATENT DOCUMENTS

| | | | |
|---|---|---|---|
| 52378 | 11/1982 | Japan | 123/492 |
| 56143 | 4/1985 | Japan | 123/492 |
| 75740 | 4/1985 | Japan | 123/492 |

*Primary Examiner*—Tony M. Argenbright

*Attorney, Agent, or Firm*—Charles E. Brown; Charles A. Brown

[57] ABSTRACT

A device is proposed for gasoline feeding to an internal combustion engine, comprising injectors for injecting gasoline in the nearby of intake valves under low- and medium-load operating conditions, and valve means to feed gasoline into the feed manifold under high-load operating conditions.

3 Claims, 1 Drawing Sheet

GASOLINE FEED DEVICE FOR INTERNAL COMBUSTION ENGINE

Figure 1:
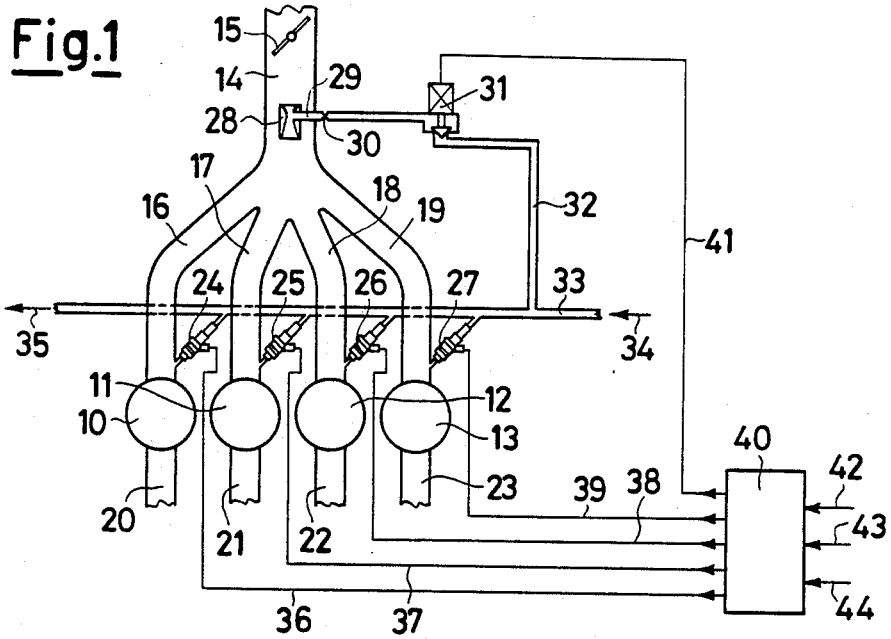

The present invention consists in a device for gasoline feeding to an otto-cycle internal combustion engine, wherein the metering of the gasoline and the mixing thereof with air are optimized under the different engine's operating conditions.

Generally, the otto-cycle internal combustion engines are fed either by means of carburettors, or by means of indirect-injection devices, of the type provided with a plurality of injectors, i.e., with as many injectors as the cylinders are (the so-called multipoint types), or of the single-injector type (the so-called single-point type).

Each of these feeding systems shows specific advantages, but involves also some drawbacks.

For example, the carburettors, as well as the single-injector injection systems are low-cost systems, and have the advantage of supplying a very homogeneous mixture under high engine load conditions, inasmuch as the gasoline is injected into a high-speed air stream, at a certain distance from the intake valves; thus, it is under the most favourable conditions for uniformly distributing throughout the air, and burn with the highest efficiency.

But the gasoline deposits on intake ducts walls, which occur with these systems, involve, under the low-load engine operating conditions, inaccuracies in cylinders-filling mixture titre (air/gasoline ratio)and have a negative influence on gasoline consumptions and on exhaust environment-polluting emissions.

The injection devices of the multipoint type secure a very precise metering of gasoline, even under low-load conditions, and, as the injectors are generally situated in the nearby of the intake valves, the titre of the cylinders-filling mixture reaches the pre-established values; but, precisely due to the position of the injectors, it may happen that air-gasoline mixture be poorly homogeneous, even under high-load operating condition, because the gasoline cannot disperse uniformly throughout the air.

Purpose of the present invention is a gasoline feeding device, which overcomes the problems of the feeding systems of the prior art, and ensures a correct metering and a good mixing with air under all of engine operating conditions.

Thus, in the air feeding system of an internal combustion engine, comprising a feed manifold and individual feed ducts connected to the same manifold and to respective cylinders, a gasoline feeding device has been provided, which comprises a feed pipe for feeding said gasoline under a pre-established pressure, injectors positioned in said individual feed ducts, in the nearby of the intake valves of the respective cylinders, and connected to said gasoline feed pipe, and a control unit operatively connected to said injectors and to sensors of preselected engine operating parameters, the device being characterized in that it additionally comprises valve means connected to said gasoline feed pipe and able to deliver said gasoline into said feed manifold, wherein also above-said valve means are operatively connected to said control unit to be controlled to deliver said gasoline into the same manifold under preestablished engine operating conditions, as defined by prefixed values of determined engine operating parameters.

According to a preferred solution, said valve means deliver gasoline into the manifold through a calibrated nozzle, which can be either separated from said valve means, or incorporated inside them, to form a further injector.

By this solution, the injectors can be controlled to feed the engine under low-load and medium-load conditions, whilst under high-load conditions, said valve means can start operating; thus, under the different engine operating conditions, an accurate metering of the gasoline and an excellent mixing with air are achieved.

Characteristics and advantages of the invention are now illustrated with reference to the hereto attached FIGS. 1 and 2, wherein preferred forms of practical embodiment of the same invention are shown to exemplifying, not-limitative purposes.

Figure 2:
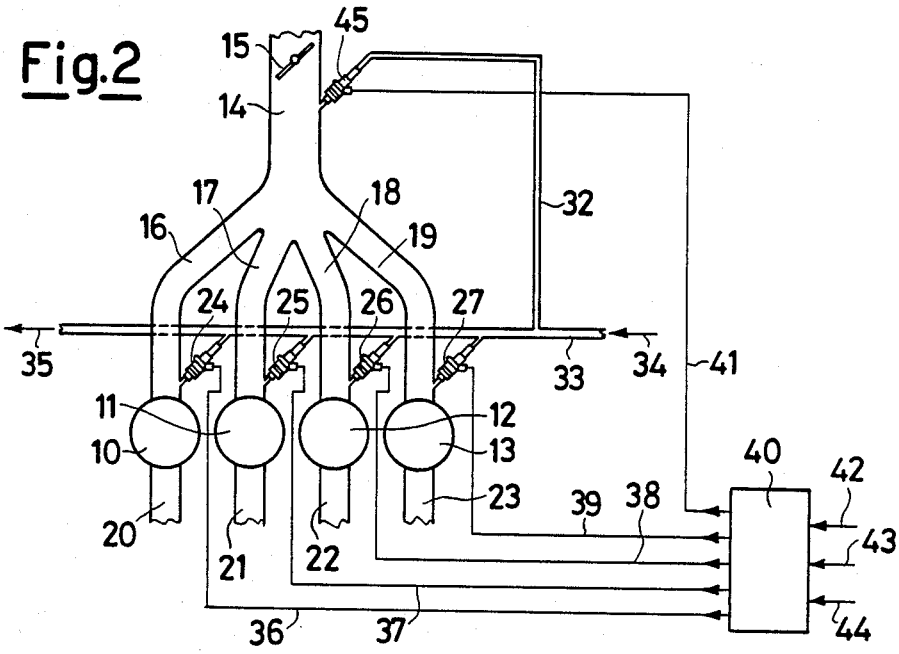

In FIG. 1, a schematic view is shown of an air feeding system for internal combustion engines, provided with a gasoline feeding device, according to the invention; and In FIG. 2, a variant is shown of the device of FIG. 1.

In FIG. 1, with 10, 11, 12, 13 indicated are four cylinders of an internal combustion engine, with 14 indicated is a manifold for air supply to said cylinders, and with 15 a choking throttle is indicated, which can be actuated by means of a not-shown accelerator pedal, to the purpose of adjusting the engine-supplied power to the different loads.

With 16, 17, 18, 19 indicated are individual ducts, which branch off manifold 14, to feed their respective cylinder.

Then, with 20, 21, 22, 23 indicated are exhaust ducts from the same cylinders.

Inside ducts 16, 17, 18, 19 electroinjectors 24, 25, 26, 27 are provided, each of which is installed in the vicinity of the intake valve, not shown, of the respective cylinder.

In the manifold 14 a venturi duct or centering element, indicated with 28, is provided, into the narrowest section of which a small duct 29 leads, which is provided with a calibrated port or nozzle 30, and is connected to an electrovalve, indicated with 31.

The calibrated nozzle 30 and the electrovalve 31 form valve means able to deliver gasoline into said manifold 14.

The electrovalve 31 is connected in its turn to a pipe 32, branched from a pipe 33, which receives gasoline under a determined pressure, in the direction as indicated by an arrow 34, from a pump, not shown; the pipe 33 feeds gasoline to the electroinjectors 24, 25, 26, 27 and discharges the excess, in the direction as shown by an arrow 35, into the gasoline tank, not shown, through a pressure control valve, it too not shown, by being of known type.

The electroinjectors are connected by means of respective electrical power supply lines 36, 37, 38, 39 to a control unit 40, to which also a line 11, feeding electrical power to electrovalve 31, is connected.

Into the control unit 40 the signals schematically shown by arrows 42, 43, 44 enter, which are supplied by sensors of preselected engine operating parameters, for example, revolution speed and timing of engine, angle of choking throttle 15 or flow rate of engine-intaken air, engine temperature.

Of course, to the control unit 40 the signals relating to further engine operating parameters, such as, e.g., temperature and pressure of engine feeding air, could arrive.

In the feed system as shown, the flow rate of air intaken by the engine cylinders is controlled by the opening of the choking throttle 15, by means of the accelerator pedal, whilst the gasoline introduced into the air to carburize it, is metered by the control unit 40, as a function of engine-operating parameters. The control unit 40 computes the amount of gasoline which is injected by the electroinjectors 24, 25, 26, 27, up to preselected values of engine revolution speed and choking throttle 15 opening angle, and controls the actuation of the same electroinjectors as disclosed, e.g., in the U.S. Pat. No. 4,346,443 to the same Applicant.

For values of engine revolution speed and of choking throttle angle higher than the above said values, the control unit 40 computes the amount of gasoline to be delivered to the engine, e.g., by a process similar to that as disclosed in above cited U.S. Pat. No. 4,346,443, and commands electrovalve 31 to open for the time corresponding to computed amount, so that the gasoline is delivered, through the nozzle 30, into air flowing through manifold 14.

Under these conditions, the control unit 40 can disable the electroinjectors 24, 25, 26, 27 at the end of an operation stroke in overlapping relationship, or can command them to contemporaneously deliver to nozzle 30 a portion of the gasoline required by the engine.

Thus, under low-load and medium-load operating conditions, the gasoline metering is carried out through electroinjectors 24, 25, 26, 27, installed in the nearby of intake valves, so to guarantee the highest precision in titre of cylinders-feeding mixture, whilst under high-load conditions, the delivery of gasoline is accomplished by means of a nozzle 30, which leads to the feed manifold 14, so to allow the best mixing with air.

Thus, with the proposed solution, low gasoline consumptions and reduced emissions of pollutants are achieved under engine low-load and medium-load operating conditions, and the highest specific powers are obtained under engine high-load operating conditions.

In the variant of the device, as shown in FIG. 2, the calibrated nozzle is incorporated in the same electrovalve, which thus embodies, as the valve means, an electroinjector, indicated with 45.

As to the remaining aspects, the device is equal to that shown in FIG. 1, and operates in an analogous way.

Finally, the single choking throttle 14 could be replaced by individual choking throttles, provided in ducts 16, 17, 18, 19 and suitable to be contemporaneously actuated by the accelerator pedal.

We claim:

1. Gasoline feeding device for a multi-cylinder internal combustion engine equipped with an air feeding system comprising a feed manifold and individual feed ducts connected to the same manifold and to respective cylinders, wherein said gasoline feeding device comprising a feed pipe for feeding gasoline under a pre-established pressure, injectors being positioned in said individual feed ducts in the vicinity of the intake values of the respective cylinders and being connected to said gasoline feed pipe, and a control unit being operatively connected to said injectors and to sensors of preselected engine operating parameters, said device being characterized in that it additionally comprises valve means being connected to said gasoline feed pipe and for delivering the gasoline into said feed manifold, said valve means being also operatively connected to said control unit which controls delivery of the gasoline into the feed manifold under pre-established engine operating conditions, as defined by prefixed values of determined engine operating parameters whereby said injectors and said valve means can operate both individually and in overlapping relation according to the control program of said control unit in response to load conditions of the engine.

2. Device according to claim 1, characterized in that it further comprises a calibrated nozzle through which said valve means delivers gasoline into said feed manifold.

3. Device according to claim 1, characterized in that said valve means are constituted by a further injector.

* * * * *